US008502101B2

(12) United States Patent
Niemeyer et al.

(10) Patent No.: US 8,502,101 B2
(45) Date of Patent: Aug. 6, 2013

(54) CIRCUIT BREAKER

(75) Inventors: Lutz Niemeyer, Birr (CH); Martin Seeger, Oberentfelden (CH); Michael Schwinne, Rheinfelden (CH); Arthouros Iordanidis, Baden (CH)

(73) Assignee: ABB Research Ltd, Zurich (CH)

( * ) Notice: Subject to any disclaimer, the term of this patent is extended or adjusted under 35 U.S.C. 154(b) by 54 days.

(21) Appl. No.: 13/250,004

(22) Filed: Sep. 30, 2011

(65) Prior Publication Data

US 2012/0037599 A1 Feb. 16, 2012

Related U.S. Application Data

(63) Continuation of application No. PCT/EP2009/053713, filed on Mar. 30, 2009.

(51) Int. Cl.
*H01H 33/88* (2006.01)

(52) U.S. Cl.
USPC ..... 218/51; 218/48

(58) Field of Classification Search
USPC ..... 218/48, 58–63
See application file for complete search history.

(56) References Cited

U.S. PATENT DOCUMENTS

| | | | | |
|---|---|---|---|---|
| 3,670,125 | A * | 6/1972 | Calvino y Teijeiro | 218/53 |
| 3,816,684 | A * | 6/1974 | Y Teijeiro | 218/63 |
| 3,949,182 | A * | 4/1976 | Calvino y Teijeiro | 218/51 |
| 4,089,744 | A | 5/1978 | Cahn | |
| 4,471,188 | A * | 9/1984 | Van et al. | 218/61 |
| 4,577,073 | A * | 3/1986 | Talpo | 218/59 |
| 4,633,049 | A * | 12/1986 | Pinnekamp | 218/59 |
| 4,754,109 | A | 6/1988 | Thuries et al. | |
| 5,723,840 | A | 3/1998 | Bojic et al. | |
| 5,905,243 | A * | 5/1999 | Zehnder et al. | 218/54 |
| 5,929,409 | A * | 7/1999 | Zehnder et al. | 218/48 |

(Continued)

FOREIGN PATENT DOCUMENTS

| | | | |
|---|---|---|---|
| DE | 11 27 442 | B | 4/1962 |
| EP | 0 239 932 | A1 | 10/1987 |
| EP | 0 741 399 | A1 | 11/1996 |
| FR | 2 575 594 | A1 | 7/1986 |
| JP | 11-086697 | A | 3/1999 |

OTHER PUBLICATIONS

*International Search Report (PCT/ISA/210) issued on Dec. 23, 2009, by European Patent Office as the International Searching Authority for International Application No. PCT/EP2009/053713.

(Continued)

*Primary Examiner* — Truc Nguyen
(74) *Attorney, Agent, or Firm* — Buchanan Ingersoll & Rooney PC

(57) ABSTRACT

An exemplary high voltage circuit breaker includes an interruption chamber that is filled with an extinguishing agent. The interruption chamber having at least two separable arcing contact pieces that are coaxially arranged and an arcing zone in which an electric arc is producible during an interruption process. The interruption chamber includes at least two inlets and at least one outlet located in between the two inlets. The inlets and the at least one outlet are connected with the arcing zone such that the electric arc is extinguishable in at least three arc interruption zones by means of extinguishing flows streaming out of the at least two inlets into the arcing zone upon pressurization and introduction of a portion of the extinguishing agent in the arcing zone, and leading an amount of the extinguishing flows through the outlet out of the arcing zone.

27 Claims, 6 Drawing Sheets

U.S. PATENT DOCUMENTS

| | | | | |
|---|---|---|---|---|
| 5,978,200 | A * | 11/1999 | Konma et al. | 361/123 |
| 7,893,379 | B2 * | 2/2011 | Schoenemann et al. | 218/157 |
| 8,148,660 | B2 * | 4/2012 | Seeger et al. | 218/51 |

OTHER PUBLICATIONS

*Written Opinion (PCT/ISA/237) issued on Dec. 23, 2009, by European Patent Office as the International Searching Authority for International Application No. PCT/EP2009/053713.

*Mori et al., "Investigation of Technology for Developing Large Capacity and Compact Size GCG", IEEE Transactions on Power Delivery, Apr. 1997, pp. 747-753, vol. 12, No. 2.

Notification Concerning Transmittal of International Preliminary Report on Patentability (Forms PCT/IB/326 and PCT/IB/373) and the Written Opinion of the International Searching Authority (Form PCT/ISA/237) issued on Oct. 13, 2011, in the corresponding International Application No. PCT/EP2009/053713.

* cited by examiner

CIRCUIT BREAKER

RELATED APPLICATIONS

This application claims priority as a continuation application under 35 U.S.C. §120 to PCT/EP2009/053713, which was filed as an International Application on Mar. 30, 2009 designating the U.S., the entire contents of which is hereby incorporated by reference in its entirety.

FIELD

The disclosure relates to electric circuit breakers, such as, high voltage electric circuit breakers and including electric circuit breakers of the gas-blast type.

BACKGROUND INFORMATION

In known systems electrical transmission lines leading from a power source such as a generator, to consumers are protected against insulation failure or overload by at least one circuit breaker. In certain instances the circuit breaker includes mechanical switching devices having a pair of conductor terminals and a bridging member for opening and closing the gap in between said terminals. Because it is not possible to interrupt a high voltage or a large electrical current instantaneously, the electric arc emerging in the expanding gap upon pulling the conductor terminals apart is often spread and broken in an insulation gas environment, such as pressurized air or sulfur hexafluoride for example. The high voltage circuit breaker market is increasingly dominated by self-blast technology.

FR 2575594 discloses a representative of such a self-blast-type circuit breaker (GCB) using SF6 as an extinguishing agent. The arrangement includes movable and immovable electrical contacts located in an arcing zone such that an electric arc is generated in the arcing zone. A pressure chamber arrangement is connected by channels to the SF6-filled arcing zone for enhancing the breaking quality by preventing the electric arc from becoming revitalized after an initial extinction.

In known systems, the highest short-line fault ratings (SLF) are covered by puffer type gas circuit breakers such as tank SF6 puffer circuit breakers for example. If limits above 50 kA, 245/300 kV are to be achieved by employing such puffer type circuit breakers expensive line to ground or grading capacitances are specified.

There have also been attempts in scaling-up known self-blast technology puffer breakers to withstand ratings of 63 kA at 300 kV, in a 60 Hz environment having 450 Ohm without a delay in time.

Known GCB features a quenching chamber, also known as interruption chamber, which is filled with an insulating gas. The chamber extends along a longitudinal axis and is designed to be radially symmetric, (e.g., rotationally symmetric about said longitudinal axis. The quenching chamber further includes at least two separable arcing contact pieces coaxially arranged and facing each other as well as an arcing zone formed in between the at least two arcing contact pieces. An electric arc burns between the at least two arcing contact pieces during a disconnection/interruption process and heats up the isolating gas in the arcing zone when the contact pieces are separated. The heat causes an increase of the pressure of the insulating gas in the arcing zone of the GCB. The pressurized gas escapes through at least one dedicated annular gap between an arcing contact piece and the quenching chamber and through cavities arranged proximal to the longitudinal axis in the contact pieces, if any, such that each emerging flow path constitutes an optimal gas nozzle. Thus, in the context of the present disclosure, the term nozzle describes a functional flow rather than a physical component.

Known attempts to achieve the above ratings with scaled-up self-blast technology puffer breakers failed because higher pressure values are expected which lead to mechanical failure of the material of the GCB and an undesired reduction of the dielectric withstand of the insulating gas due to the associated high temperature of above 2000K.

There are two situations under which a high-voltage circuit breaker, in particular a high-voltage alternating current circuit breaker, should endure. The first situation is known as a short line fault (SLF) and the second situation is known as a terminal fault (T100a).

In a GCB, the pressure in the arcing zone should be comparatively high for extinguishing the electric arc in a reliable manner in case of a short line fault. One drawback, however, is that a high pressure raises the thermal load to the structure of a circuit breaker. With respect to a terminal fault, the current pressure values in the arcing zone exceed the pressure values that are specified for reliably extinguishing the electric arc, which are comparatively low. Hence, in case of a GCB, the gas nozzle should be able to bear the pressure in the arcing zone in the SLF situation, as well as withstand T100a conditions.

In "Investigation of Technology for Developing Large Capacity and Compact Size GCB" disclosed in the IEEE Transactions on Power Delivery, Vol. 12, No. 2 dated April 1997, a different solution for achieving the above-mentioned ratings by employing different nozzle geometry is proposed. This nozzle is different from other known GCB applications because of an inner nozzle that is assigned to a movable arcing contact wherein said inner nozzle contributes to the establishment of local higher gas pressures specified for the thermal interruption at a SLF without only increasing the pressure in a dedicated puffer chamber of a GCB.

There remains the drawback, that high gas pressures are known to cause high temperatures which in turn are undesired for dielectric interruption since the gas becomes conductive above 2000 Kelvin such that it can not be employed sensibly for breaking an electric arc in case of SF6 gas employed as the extinguishing agent in a GCB.

SUMMARY

An exemplary high-voltage circuit breaking method is disclosed. The method comprises providing an interruption chamber filled with an extinguishing agent, said interruption chamber having one arcing zone and at least two separable arcing contact pieces that move relative to one another; separating the at least two arcing contact pieces from one another such that an electric arc is generated between said arcing contact pieces in the arcing zone; and interrupting said electric arc in at least three interruption zones, wherein two groups of interruption zones are formed, wherein one group has at least one interruption zone, and wherein both groups are separated by an outlet through which a portion of said extinguishing agent is led out of said arcing zone.

An exemplary high voltage circuit breaker is disclosed. The high voltage circuit breaker comprises an interruption chamber filled with an extinguishing agent; at least two separable arcing contact pieces that are movable relative to one another; and one arcing zone in which an electric arc is producible in between the at least two separable arcing contact pieces during an interruption process, wherein said interruption chamber includes at least two inlets and at least one outlet located in between the two inlets, and said inlets and the at least one outlet are connected with said arcing zone such that the electric arc is extinguishable in at least three interruption zones which are formed by means of extinguishing flows of extinguishing agent streaming from the at least two inlets into the arcing zone upon pressurization, wherein a portion of the extinguishing agent is inserted in said arcing zone, and wherein a portion of said extinguishing flows is led through said outlet out of the arcing zone.

BRIEF DESCRIPTION OF THE DRAWINGS

Such description makes reference to the annexed drawings, which are schematically showing the following.

In the drawings identical parts, flows and flow nozzles are designated by identical reference characters.

DETAILED DESCRIPTION

Figure 1:
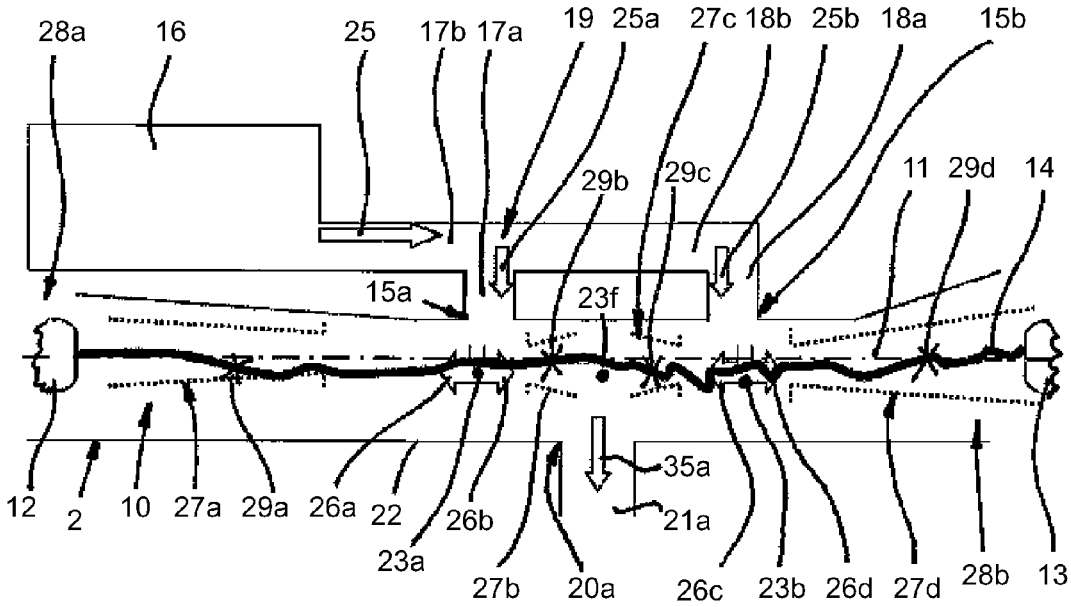
FIG. 1 illustrates a longitudinal view of a first circuit breaker in accordance with an exemplary embodiment.

Exemplary embodiments of the disclosure provide a circuit breaking method and a circuit breaker that overcome at least some of the drawbacks of known devices in a reliable and economic manner in view of ratings of more than about 50 kA at 300 kV. Furthermore, exemplary embodiments of the present disclosure provide a method and a single-chamber device suitable for self-blast type AC circuit breaking using gas as the isolating extinguishing agent.

An exemplary embodiment of the present disclosure is directed to a method for high-voltage circuit breaking. The method includes the following activities:

Providing an interruption chamber filled with an extinguishing agent. The interruption chamber having a one arcing zone and at least two separable arcing contact pieces that are arranged to be moveable coaxially relative to one another Separating the at least two arcing contact pieces from one another by moving them away from each other such that an electric arc is generated between the electrical contact pieces in the arcing zone Interrupting the electric arc in at least three interruption zones. Where two groups of interruption zones are formed, one group has at least one interruption zone, and wherein both groups are separated by an outlet through which a portion of the extinguishing agent is led out of the arcing zone.

In the context of the present disclosure, interruption zone and arc interruption zone can be understood broadly as an area where the electric arc is interrupted by an extinguishing flow of an extinguishing agent.

In addition interruption zone can be a zone, area or region where the electric arc is actually interrupted.

The exemplary HV circuit breaking method of the present disclosure can also be referred to as a multiple interruption zone method. In this method, the electric arc is broken into fragments during the breaking process whereas all fragments are located within the same arcing zone/chamber, and the at least two separable arcing contact pieces are physically contacting each other in the closed state of the circuit breaker.

Described differently, in the exemplary interruption method, the step of interrupting the electric arc can be performed by leading (at least two) extinguishing flows into the arcing zone such that at least three interruption zones are formed. A portion of the extinguishing agent can be led out of the arcing zone through an outlet, and wherein at least one of the interruption zones is separated from the other interruption zones by the outlet.

The arc interruption can be achieved by leading at least two extinguishing flows into the arcing zone through inlets and at the same time leading a portion of the extinguishing agent out of the arcing zone through an outlet that is located between the two inlets. As a result, at least one of the at least three interruption zones is present in between the two inlets.

Advantages of the exemplary breaking method, as a result characteristics of a high voltage AC current breaker are described below.

In known high voltage AC GCB employing Sulfur-Hexafluoride (SF6) as the extinguishing agent, a gas flow of the pressurized SF6 gas is led into the arcing zone and allowed to escape in two opposing directions within the interruption chamber such that the flow splits in two branch-offs. Each branch-off forms a gas nozzle with one axial interruption zone where the electric arc is broken/interrupted. A stagnation zone, whose gas pressure is about equal to that of the pressurized gas in a pressure volume or heating volume, if any, is located in between the interruption zones of the same group of interruption zones. The geometrical definition given in regard of the interruption zone applies likewise for the stagnation zone.

The breaking effect provided through the exemplary breaking method can be considerably increased as compared to known HV circuit breaker having two or more radial inlets but no radial outlet where only two axial interruption zones can be generated. The increase can be realized because the portion of the extinguishing agent that is led out of the arcing zone through the outlet transform the formerly dead stagnation zone in between the two interruption points into an active interruption area with additional interruption zones, e.g. two additional axial interruption zones compared to the known device.

In the context of the present disclosure the term inlet denotes an area of the HV circuit breaker where an extinguishing flow of extinguishing agent is entering the arcing zone at the time of arc extinguishing (e.g. by means of blowing) and/or an area of the HV circuit breaker where an extinguishing flow is leaving the arcing zone at the time of arc extinguishing.

Due to the presence of a plurality of interruption zones the exemplary HV breaking method of the present disclosure includes a nozzle system having more than two fluid nozzles. With the exception of a cross-blown interruption zone discussed in greater detail below, the nozzle lengths of the nozzle system in a GCB having axial interruption zones exclusively are proportional to the number of interruption and stagnation zones.

Breaking or interrupting the electric arc in more than one interruption zone can contribute to an achievable decrease of the specified pressure in case that the exemplary high voltage circuit breaker is employing gas as the extinguishing agent. The resulting pressure values in an exemplary HV self-blast type SF6 circuit breaker of the present disclosure are comparable to the nominal pressure values of known GCB's intended for ratings of about 50 kA at 300 kV in a 60 Hz environment. Known, the impact on the physical structure and components of the exemplary circuit breaker remains substantially the same such that a safe long-lasting use of the inventive high voltage circuit breaker is achievable.

Because of the present disclosure the above pressure values are maintainable below a range where disadvantageous gas properties regarding the dielectric withstand of the gas occur, the exemplary embodiments of the present disclosure allow for achieving good dielectric interruption values.

Employing an insulating gas other than SF6 in the inventive GCB will lead to different pressure values.

Theoretically it would be advantageous to have as many interruption zones as possible but there are factors like the available time frame within which the interruption has to take place and the physical overall length of the interruption chamber that limit the number of interruption zones. Excellent interruption values can be achievable with an embodiment having six interruption zones. In an exemplary embodiment of the present disclosure, these six interruption zones can be assigned to three groups of interruption zones, each group of interruption zones has two axial interruption zones.

In another exemplary embodiment of the present disclosure, each of the three groups of interruption zones can be assigned one extinguishing flow that is led into the arcing zone, where two neighboring groups are in each case separated by an outlet.

The at least two neighboring groups are in an exemplary embodiment can be separated from one another by a stagnation zone located therebetween.

The exemplary HV circuit breaking method of the present disclosure allows a successful breaking of the electric arc in more than one interruption zone at about the same time at ratings of the circuit to be broken of about 63 kA at 300 kV, in a 60 Hz environment/network having 450 Ohm resistance without a delay in time.

Furthermore, the exemplary method allows the time span to be kept as short s possible where the electric arc is present. In an exemplary embodiment having a self-blast type GCB using gas, (e.g., SF6 gas), a pressure build-up in a pressure chamber is nonetheless sufficiently strong for extinguishing the electric arc within the arcing zone in due time. Thus, the exemplary HV-breaking method provides for a reliable, rapid extinction of the electric arc as well as inhibiting the electric arc after an initial extinction.

The exemplary HV breaking method allows the assignment of a thermal interruption to one group of interruption zones or at least to one part of the group of interruption zones and a dielectric interruption with non- or low ionized extinguishing agent to another group of interruption zones or a part thereof, if specified, as well as the provision of a dielectric gap, as desired.

The exemplary HV-breaking method is powerful and reliable when used for breaking an alternating current. In the context of the present disclosure, the term alternating current can also encompass alternating currents having a direct current portion when as long as there is a zero crossing.

Although the set-up and the extinguishing process have described by example of an exemplary SF6 self-blast-type GCB the general concept of the multiple interruption zones can be adaptable to achieve successful HV circuit breaking using other extinguishing agents such as nitrogen, pressurized air or a mixture thereof as well as to liquid extinguishing agents such as oil, switch-ester, fluorinated chemicals and the like.

In an exemplary embodiment the HV GCB is a single chamber high-end self-blast gas HV circuit breaker (GCB). As a result, the exemplary breaking method can be used without a parallel line to ground or grading capacitances.

Thus, exemplary embodiments of the present disclosure provide an alternative to known puffer type circuit breakers for coping with the highest short-line fault ratings which are subject to an increasing demand. An exemplary method for HV circuit breaking of the present disclosure is particularly suitable for breaking an electric arc generated by an alternating current (AC).

If an exemplary method of the present disclosure is arranged such that the electric arc in between the arcing contact pieces is generated as a non-supported electric arc, the complexity of the breaker design can be kept at a minimum which contributes to both an economic production of the HV circuit breaker as well as its use and maintainability. In this case the electric arc of the high-voltage circuit breaking method extends continuously between exactly two arcing contact pieces.

Even where there are more than exactly two arcing contact pieces, e.g. in that there is an intermediate pair of arcing contact pieces between the first and the second arcing contact piece, exemplary embodiments of the present disclosure can be maintainable as long as all arcing contact pieces are arranged within the same arcing zone such that the extinguishing gas flows are connected. Thus, the intermediate pair of arcing contact pieces can be provided for shortening a comparatively long arcing time, wherein a portion of the extinguishing agent is led off the arcing zone through an outlet at the intermediate arcing contact pieces. Depending on the arrangement of the exemplary embodiment, the electric potential of the intermediate arcing contact pieces can be floating.

Depending on the rating and the specified type interruption specified, e.g. thermal interruption, an exemplary embodiment can interrupt the electric arc by cross-blowing in at least one group of interruption zones, hereinafter also referred to as a group of radial interruption zones or group of cross-blown interruption zones. Accordingly such an interruption method is referred to as cross-blow concept.

In an SLF, the transient voltage recovery (TRV) takes place within a very short time span after crossing the zero point also referred to as current zero. Any rapid oscillations of the current occurring within the time span can feature comparatively steep slopes when displayed in an lit-diagram. As a result of ratings of more than about 50 kA at about 300 kV very high temperatures of about 2000K (Kelvin) can be expected. Thus, the arc breaking at the time of an SLF event is also referred to as thermal interruption. Somewhat lower temperatures can be expected in a T100 case taking place usually less than 1 second after the zero crossing.

Depending on the circumstances, according to the an exemplary breaking method of the present disclosure, an electric are can be broken in at least two groups of axial interruption zones, in at least two groups of cross-blown interruption zones or in a group with at least one axial interruption zone in combination with a group of cross-blown interruption zones. These embodiments and their features shall be explained hereinafter by using an exemplary HV-GCB forming a non-limiting representative of an inventive breaker type.

The at least two groups of axial interruption zones of the circuit breaker working according to a first exemplary embodiment feature identical characteristics. However, a differentiation of the groups of axial interruption zones amongst them is achievable by adapting the gas flows to the desired specification or breaking situations. Depending on the circumstances, such adapting can be achievable by varying the, i.e. pneumatic resistance means for the gas flows, at the inlet area for example. In an exemplary embodiment, a first gas flow can be configured or modified in view of a second gas flow by narrowing the diameter of the at least inlet that is assigned to the first gas flow.

Another advantage of the breaking method working according to a first exemplary embodiment is that it enables the building up of a dielectric gap parallel to the thermal interruption.

It is further advantageous to assign the thermal interruption to a first group of axial interruption zones and the dielectric interruption to another group of axial interruption zones because it allows an independent configuration of each group of interruption zones what in turn contributes to an optimization of the cycle times. The appointment of the different interruption types to different groups of interruption zones enables shorter arcing times in a T100a test, for example.

In an exemplary embodiment, an appointment of the different interruption types/situations to different groups of interruption zones can be achievable and/or optimizable e.g. by providing a shield acting as a field-electrode to the thermal interruption zone. A shield can be assigned to a first one of the separable arcing contact pieces and shift the streamlines of an electric field towards a second one of the separable arcing contact pieces during the interruption process. A field-electrode can be electrically connected to the first arcing contact piece whereas its front end is located substantially close the interruption zone where the dielectric interruption shall take place, whereas attention shall be given to the presence of a dielectric gap. However, the interruption nozzles need not necessarily coincide with the dielectric gap. It is possible that a part of the nozzle system where the interruption takes place is shielded and does not influence the dielectric performance of the circuit breaker.

A further advantage of the exemplary breaking method according to the first exemplary embodiment that it can be achieved in a HV circuit breaker having a substantially symmetric design circuit the longitudinal axis, for example having substantially annular nozzle gaps and/or inlets and/or at least one outlet. In the context of the present disclosure the term symmetric describes an arrangement that functionally is substantially symmetric about an axis with tolerances for a design of the circuit breaker specifying bars and other structures that are present in at least some channels, chambers and/or volumes as desired. Hence symmetrical deviations resulting from varying designs can be neglected as long as their influence is minimal and the technical effects achieved by associated exemplary embodiments of the present disclosure are maintained.

In addition, enhanced cooling of the interruption zone that is dedicated to the thermal interruption contributes further to good interruption values.

Also the second exemplary embodiment of the breaking method contributes to a basic design that can be asymmetric about the longitudinal axis. Good arc breaking results can be achieved by such an arrangement in particular upon breaking comparatively low currents causing a small pressure in a self-blast type GCB.

The advantages of the third exemplary embodiment of the breaking method of the present disclosure reside in an optimal solution to address the SLF and T100a events by allocating at least one separate group of interruption zones to each event. As a result, an optimization of each group of interruption zones is allowed according to particular SLF and T100a demands that can be subject to diverging particularities.

A third exemplary embodiment of an HV blast-type GCB arrangement of the present disclosure includes a first group of interruption zones formed by a common circuit breaker arrangement. An additional second group of interruption zones is formed and provides for cross-blowing the electric arc in an add-on unit. Both groups of interruption zones can be located in the same arcing zone. Such an arrangement is suitable in a SLF90 situation according to the IEC norm. When the cross-blowing breaking method is used for thermal interruption only, the interruption zones are placed advantageously in the add-on located in a shielded region as the dielectric interruption is likely to be worse than that of a double axial blown arc as the electric field strength is high. The gas flows should originate from different locations, for example pressure reservoirs, in order to achieve the desired separation of the group with the axial interruption zones and the group with the cross-blown interruption zones.

It can be beneficial to allocate the group with the cross-blow interruption zones in a region with reduced radiation and thus to separate the place where the pressure is generated from the actual interruption zones in order to profit from a maximal ablation of insulating material, derived e.g. of an PTFE-insulation nozzle, at the place where the heat and pressure cannot easily disappear, i.e. in a certain distance to any outlet channels. Such a set-up contributes to the efficiency of the arc breaking such that exemplary embodiments of the present disclosure is qualified to be employed in an interruption method arranged according to the second or third exemplary embodiments.

The shielding described for the exemplary HV circuit breakers working according to a first exemplary embodiment is applicable for supporting the breaking effect for dielectric interruption of the HV circuit breakers working according to the second or third exemplary embodiments.

Summing up, the arcing zone of an exemplary embodiment of the high-voltage circuit breaking method of the present disclosure defines a longitudinal axis. At least one extinguishing flow of extinguishing agent is led into the interruption zone transversely to the longitudinal axis such that a group of radial interruption zones, in particular a group of cross-blown interruption zones is formed and/or at least one extinguishing flow is led into the interruption zone such that a group of axial interruption zones is formed.

In addition or as an alternative, the at least one group can include two axial interruption zones and a stagnation zone located therebetween on the longitudinal axis.

The actual breaking of the electric arc is performed by leading an extinguishing flow of the extinguishing agent into the arcing zone through the at least two inlets and by leading a portion of the extinguishing agent out of the arcing zone through an outlet, i.e. at least one outlet, is located in between two inlets. In the context of the present disclosure the term "in between" shall be understood as any location on a fictional axis that connects the two inlets.

The outlet enables a movement of the extinguishing agent originating from a branch-off flow each from two neighboring groups of interruption zones which movement contributes to establishing at least one additional interruption zone.

When the exemplary HV breaking method is performed in a self-blast type SF6 GCB, the pressurized gas can be allowed to escape through at least one dedicated annular gap between a first and second arcing contact piece and the quenching chamber and through cavities arranged proximal to the longitudinal axis in the contact pieces, if any, as well as through the outlet that is also connected to an exhaust.

Depending on the circumstances and specifications, the extinguishing flow caused by an adequate internal or external pressurization of the extinguishing agent. This can be achieved by means of an externally generated actuated system, (e.g., an external pressurization system). Alternatively an internally-actuated system, (e.g., a self-actuating pressure system) puffer-type or piston-based pressurization means can be employed.

For an exemplary self-actuating pressure system of the present disclosure, the pressurization of, for example, a gaseous extinguishing agent can be achieved in at least one pressure volume is connected to the arcing zone by a heating channel due to energy generated by the electric arc. During the interruption process the pressurized gas interrupts the electric arc in each group of interruption zones in that the pressurized gas is led via a blowing channel through the corresponding inlet into the arcing zone at the time of actual arc breaking.

Leading the extinguishing isolating gas through the heating channel into a pressure volume, also referred to as heating volume, for pressurization and leading it out thereafter through a blowing channel that is discharging into the arcing zone at the inlet, especially in case that the heating flow and the blowing flow are lead through the same channel, that is employed both for heating and blowing, contributes to reducing the degree of complexity of the exemplary breaking method of the present disclosure and the corresponding exemplary HV circuit breaker without affecting versatility.

According to exemplary embodiments of the present disclosure, an effective way of breaking the electric arc at a plurality of interruption zones can be achieved by producing a plurality of streams or flows of extinguishing agents, in particular gas flows. The gas flow is lead through an inlet into the arcing zone at each group of interruption zone or interruption zones such that it diverges within the arcing zone into at least one multi-directional gas flow, in particular at least one double axial gas flow, more particular at least one double axial gas flow whose branch-offs extend along the longitudinal axis in case of a tubular-shaped interruption chamber such that at least two axial interruption zones are formed in one group of interruption zones.

By means of leading at least one branch-off of an extinguishing flow through an outlet out of the arcing zone at least one interruption zone is producible in an area that might have been a dead stagnation zone/area compared to a known HV circuit breaker having two axially distanced inlets but no outlet. Thus the breaking effect is substantially increased by the presence of at least one interruption zone. The extinguishing flow running through the outlet from the arcing zone forms a sort of an auxiliary flow nozzle having flow rates at about sonic conditions.

In another exemplary embodiment, each multi-directional extinguishing flow features two branch-offs after leaving its dedicated inlet discharging into the arcing zone. In an exemplary blast-type GCB breaker defining a longitudinal axis by its arcing contact pieces, the branch-off flows of the gas flows are re-directed to flow parallel to the longitudinal axis. Such an arc breaking can be also referred to as double axial blown arc interruption creating a so-called axial interruption zone. If the at least one multi-directional gas flows is configured such that the electric arc is interrupted in a substantially symmetric manner in relation to the longitudinal axis, both an optimal breaking and a simple design of the HV circuit breaker are achievable.

In another exemplary embodiment, a high voltage circuit breaker interruption chamber filled with an extinguishing agent, wherein the interruption chamber extends along a longitudinal axis. The interruption chamber having at least two separable arcing contact pieces, in particular arcing contact pieces that are arranged coaxially to one another, and an arcing zone in which an electric arc is producible in between the at least two separable arcing contact pieces during an interruption process between the arcing contact pieces. Moreover, the interruption chamber includes at least two inlets and at least one outlet located in between two inlets. The inlets and the at least one outlet are connected with the arcing zone such that the electric arc is extinguishable in at least three interruption zones which are formed by means of extinguishing flows of extinguishing agent streaming out from the at least two inlets into the arcing zone upon pressurization and insertion of a portion of the extinguishing agent in the arcing zone and leading an amount of the extinguishing flows through the outlet out of the arcing zone. In the context of the present disclosure, the term "amount of extinguishing flow" has been selected to allow a differentiation to the term "portion of the extinguishing agent" since the amount must not necessarily be equivalent to the portion.

The exemplary HV breaker of the present disclosure, can be used for breaking both non-supported and supported electric arcs alike. Although the exemplary HV circuit breaker is particularly useful for breaking alternating currents it may be suitable for breaking DC-driven electric arcs if appropriate measures are taken.

The technical effect resulting from such an arrangement resides in extinguishing the electric arc substantially simultaneously at a plurality of interruption zones of several groups of interruption zones such that both the temperature and the internal pressure within the circuit breaker and in particular the arcing zone can be kept within tolerable ranges in an arcing zone/chamber of an SF6 self-blast GCB. The resulting pressure values in an exemplary HV self-blast type SF6 circuit breaker of the present disclosure are comparable to the nominal pressures values of known GCB's intended for ratings of, for example, about 50 kA at 300 kV in a 60 Hz environment. Hence, the impact on the physical structure and components of the circuit breaker remains substantially the same such that a safe long-lasting use of the exemplary high voltage circuit breaker is achievable.

Because in the exemplary embodiments of the present disclosure the above pressure values are maintainable below a range where disadvantageous gas properties regarding the dielectric withstand of the gas occur, it is possible to achieve good dielectric interruption values.

An exemplary HV circuit breaker of the present disclosure provides a reliable, durable breaking performance including a secure inhibition of a resurrection of the plasma-arc is improvable by having at least one outlet that is connected with the arcing zone for allowing at least a portion of the extinguishing flow to leave the arcing zone such that at least one interruption zone is formed. In case of an exemplary self-blast GCB, the full axial symmetric geometry is broken in favor of the interruption zone formed in the area of the outlet instead of no interruption zone and a useless stagnation zone in case of an absent outlet.

Depending on the specifications, the at least one inlet of an embodiment of the exemplary circuit breaker is arranged such that its assigned extinguishing flow forms a stagnation zone in the arcing zone. The stagnation zone is adopted for forming a re-direction or even an inversion of the direction of the extinguishing flow or branches thereof and separates two neighboring groups of interruption zones, for example two groups of axial interruption zones.

The complexity of exemplary HV circuit breakers of the present disclosure can be kept comparatively low if the number of the arcing contact pieces, e.g. a pin or plug and a tulip-shaped counterpart, is two and the arcing contact pieces are facing each other directly such that a non-supported electric arc is producible. In the exemplary HV circuit breaker such arrangement no intermediate conductors or the like are necessary.

In exemplary embodiments of the present disclosure where the HV circuit breaker is a self-blast type gas circuit breaker, the specified flows of extinguishing gas can be generated by a pressurization means, such as a pressure volume, pressure chamber, heating volume or other suitable component as desired. In an exemplary embodiment having a plurality of pressure volumes, at least one pressure volume can be created by using a puffer-type or piston-based pressurization means for creating the specified extinguishing flow. A technique as such does not bother whether the electrical contacts are pulled apart by a single motion, a double motion or a triple motion drive.

In an exemplary high voltage circuit breaker of the present disclosure, the circuit breaker can be connected to at least one of the inlets via a blowing channel or a system of blowing channels. In principle, all inlets of a self-blast type GCB may be fed by one single pressure volume. For exemplary embodiments having exactly one pressure volume, the latter can be connected to the blowing channel via at least one of a common supply channel portion for connecting several blowing channels and a separate supply channel portion for connecting exactly one blowing channel.

An exemplary HV circuit breaker of the present disclosure can avoid having complicated channel system and can stabilize the interruption process by including at least two pressure volumes. Adjusting the different gas flows assigned to the inlets is achievable by assigning a pressure volume to each inlet and thus to each group of interruption zones. As a result, at least two of the inlets which are forming mouths of dedicated blowing channels, are connected to separate pressure volumes each via at least one of a common supply channel portion and a separate supply channel portion.

In another exemplary embodiment, the pressure volume of an exemplary HV self-blast type gas circuit breaker embodiment can be connected to the arcing zone by at least one heating channel. If the at least one pressure volume is connected each by at least one heating channel and at least one blowing channel with the arcing zone, a comparative design for the exemplary circuit breaker can be achieved which does not deviate too much of the design from circuit breakers having one group of interruption zones only. If a substantially full axial symmetric geometry or at least a quasi axial symmetric geometry of the circuit breaker is specified, at least one of a blowing channel/outlet, the heating channel and a further outlet, where applicable, as well as the at least one pressure volume is/are arranged symmetrically to a longitudinal axis can be defined by the substantially rotational symmetric arcing zone (10). In order to achieve an optimal thermal interruption quality it is favorable to arrange the inlets such that the resulting extinguishing flows act symmetrically in view of the longitudinal axis.

If the at least one pressure volume is connected to the arcing zone by the at least one inlet serving both as a heating channel and as a blowing channel a particular advantageous circuit breaker design is achievable. In such case a cross section of the channel is advantageously designed to be larger than the total sum of all cross sections of the dedicated flow-offs such as the outlet shares, for example. This effect can be enhanced by assigning the at least one pressure volume to one interruption zone what contributes to an easier geometrical realization as well as to the stability of the interruption process.

The exemplary circuit breakers of the present disclosure can be dimensioned such that a temperature of extinguishing gas in case of a self-blast SF6-GCB is kept below 2000K in order to provide good arc extinguishing properties, especially in view of the dielectric characteristics.

In another exemplary embodiment a self-blast type GCB can have axial flow interruption zones and two pressure volumes assigned to each interruption zone. Enhancing a distance (e.g., axially) between the outlets of the pressure volumes allows an effective decoupling of the individual axial extinguishing flows and thus the provision of larger pressure differences between the two pressure volumes. However, attention should be given on the fact that the overall length of the whole flow nozzle system is increased what demands for a higher plug velocity and a higher amount of drive energy. The term drive energy is used to denote the amount of energy specified for pulling the at least two arcing contact pieces from one another such that the electric arc is generated. For example, the arcing contact pieces of a GCB are realized as four separate parts, i.e. a set of nominal contacts, a plug and a piston whereas the piston and the plug are coupled to the nominal contacts with linear gears. In general it is not relevant for the exemplary embodiments of the present disclosure whether the electrical contacts are pulled apart by a single motion, a double motion or a triple motion drive.

Depending on the specifications of the exemplary embodiment at least one of the nozzles/inlets is used both for ablation and electric arc interruption.

If two neighboring groups of interruption zones are fed by the same heating volume, the distance in the direction of the longitudinal axis can be kept small as there is no significant difference of the pressure values at each inlet. In such case the heating channels can be separated for each separation zone in order to avoid a short circuiting of the electric arc.

If there are two pressure volumes having different sizes and/or differently acting fluid flow constrictions an offset in the starting time where the gas flow emerging from the pressure volume begins as well of the ending time is achievable. Such restrictions can be formed by an acting resistance means.

In another exemplary embodiment of the present disclosure the extinguishing characteristics of an extinguishing flow can be guided through the outlet, i.e. a radial outflow. The openings of the flow nozzles can be designed such that they act as diffusers. Due to the increase of the cross section of the flow a sonic condition is reached at the transition area between nozzle and diffuser.

Depending on the specifications and the purpose, the pressure built up within the heating volume, i.e. the pressure chamber, can be reducible by a valve system or a suitable means leading to the same effect.

In an exemplary embodiment of the present disclosure, an interrupting effect can be necessary to adjust two extinguishing flows such that their characteristics are comparable or set to one another according to a certain ratio. Such adjustment is feasible by the following measures both alone and in combination with each other. First, the inlets can be chosen such that the volumetric current is equal but the pressure and speed rates differ. Second, equal speed and/or pressure rates can be achieved by adjusting fluid acting resistance means assigned to at least one extinguishing flow. Depending on the situation such resistance means can be formed by the diameter and/or the shape of the inlets and/or the channels between the pressure volume and the inlets as well as the state of the surfaces of the inlet and/or the channels. The same applies likewise for the at least one outlet. Alternatively or in addition thereto the acting resistance can be adjusted by different channel lengths. Further adjustments of the interruption behavior are achievable by providing resistance or restriction means conferring different flow resistance behavior to the inlets, the at least one outlet and/or their respective channels or ducting systems. Depending on the particular embodiments of the restriction means, the latter are fully integrated in at least some of the inlet and/or outlet channels, where applicable.

It has been found that good extinguishing results are achievable if the extinguishing flows are set such that flow speeds in the range of about the sound-velocity in flow nozzles appear. As a rule, flow speeds in the range of about or above the sound-velocity threshold in as many interruption zones, (e.g., axial interruption zones) as possible can be used in view of the interruption efficiency. In an axially blown arc of a GCB, the electric arc can be constrained first and interrupted thereafter proximate to the longitudinal axis by the quenching flow coming from the inlet linked directly to the assigned pressure volume, i.e. without passing previously through an arcing zone, in the axial interruption zone that is located in a constriction of the fluid nozzle where the speed of the gas flow is comparatively high, e.g. at about sonic conditions, and leaving the axial interruption zone though an outlet.

Depending on the specifications of the desired circuit breaking and the intended use, at least one outlet of an interruption zone can be designed as a radial interruption zone, also referred to as cross-blowing interruption zone. Across-blowing interruption zone can be defined by at least one radial inwards acting inlet and at least one radial outwardly acting outlet/additional outlet of the circuit breaker in regard to its arcing zone. However, in the context of the present disclosure, the prefix "radial" is not strictly limited to a direction that is perpendicular to a longitudinal axis, defined by the electrical contacts and/or an insulation nozzle for example, rather than a transversal arrangement thereto. Such an embodiment can be suitable for handling the thermal interruption for example.

In a cross blown arc of a GCB, the electric arc can be blown away from the longitudinal axis by the quenching flow coming from the dedicated inlet linked directly to the assigned pressure volume, i.e. without passing previously through an arcing zone, in the axial interruption zone, and leaving the cross blown interruption zone though an outlet.

Depending on the embodiment, the area with the group of cross-blow interruption zones can be located on an end or in between two other groups of interruption zones such as the groups with axial interruption zones, for example. In case that the group with the cross-blow interruption zones is located in between two groups with axial interruption zones, the splitter channels form the actual breaking means of the cross-blow interrupter serving as outlets in the sense of the present disclosure at the same time. Such an arrangement allows the circuit breakers of the present disclosure to have a comparatively simple design despite its complicated exemplary function.

In an exemplary embodiment cross-blown interruption zones, can be advantageously separated in the area of pressure building of the area of arc extinction due to the ablation performance. This holds particularly true in case that the outlet is not mainly designed to form an essential part of a heating channel connected to the pressure chamber but to exemplary embodiments having separate heating and cooling channels.

Depending on the kind of arc extinction, that is an axial blow interruption or a cross-blown interruption and/or its purpose, i.e. thermal and/or dielectric interruption known principles such as the use of field-electrodes are adaptable to the devices.

Such an appointment of the different interruption types to different groups of interruption zones is achievable e.g. by providing a shield acting as a field-electrode to the thermal interruption zone. The shield is for example assigned to a first one of the separable contact pieces and shifts the streamlines of an electric field towards a second one of the separable contact pieces during the interruption process. A basic field-electrode can be achievable e.g. by a sleeve-like shielding device that is electrically connected with the nearest terminal which in turn is bond to the first contact piece whereas its front end is located suitably close towards the interruption zone where the dielectric interruption shall take place. However, the interruption nozzles need not necessarily coincide with the dielectric gap.

Depending on the specification an exemplary circuit breaker can be equipped additionally with means for applying magnet forces to the electric arc in order to stretch it such that arc instabilities are generated.

Further embodiments, advantages and applications of the disclosure will become apparent upon consideration of the following detailed description of the drawings.

FIG. 1 illustrates a longitudinal view of a first circuit breaker in accordance with an exemplary embodiment. FIG. 1 shows a longitudinal schematic and simplified breakout view of a section through an interruption chamber 2 of a self-blast type HV circuit breaker using gas SF6 as the extinguishing agent.

The interruption chamber 2 can include a substantially cylindrical arcing zone 10 that defines a longitudinal axis 11. The arcing zone 10 is limited in the axial direction by a first plug-shaped arcing contact piece 12 and a second plug-shaped arcing contact piece 13. The first arcing contact piece 12 can engage the second plug-shaped arcing contact piece 13 or vice versa such as shown, for example, in FIG. 4 or 6 which are described in detail below. The HV circuit breaker is shown in FIG. 1 has arcing contact pieces 12, 13 in their fully separated state where an electric arc 14 generated by an alternating current having a zero-crossing. The interruption chamber 2 includes a first inlet 15*a* and a second inlet 15*b* that are arranged in a distance from one another. The inlets 15*a*, 15*b* connect a pressure volume 16 via a first radial blowing channel 17*a* and a second radial blowing channel 18*a* to the arcing zone 10. The blowing channels 17*a*, 18*a* originate from dedicated horizontal supply channels 17*b*, 18*b* that branch from a common supply channel portion 17*b* at the pressure volume 16 side at a channel intersection 19.

An outlet 20*a* is arranged in between the two inlets 15*a*, 15*b* such the axial distance from its radial position to the radial entering inlets 15*a*, 15*b* is about equal. The outlet 20*a* connects the arcing zone 10 via a radial outlet channel portion 21*a* with an exhaust (not shown).

The same applies to the number of inlets 15*a*, 15*b*, as well as channels 17*a*, 18*a* and supply channel portions 17*b*, 18*b* respectively as they are arranged in plurality in a circumferential direction around the longitudinal axis 11. The total number of inlets can include an even or odd number.

As a gap between the arcing contact pieces 12, 13 is increased and an electric current is imposed the electric arc 14 expands in length and impact. The heat/radiation of the arc leads to the ablation of insulating PTFE material out of an insulation nozzle 22. Since the ablation process is well known further details referring thereto are omitted. The ablation leads to an increase of the gas pressure within the arcing zone 10 such that a portion of the gas from the arcing zone 10 is moved through the heating channels 17*a*, 17*b*, 18*a*, 18*b* into the pressure volume 16. Once the gas pressure in the pressure chamber exceeds the pressure in the arcing zone/chamber the gas flow reverses and a gas flow 25, divided into gas flows 25*a*, 25*b* of extinguishing, insulating gas SF6 gas is entering the arcing zone 10 at each inlet 15*a*, 15*b* while the electric arc 14 is still fully present. The gas flows 25*a*, 25*b* encounter fluid resistance in the arcing zone 10, from stagnation zones 23*a*, 23*b* and branch into two branch-off flows 26*a*, 26*b*, 26*c*, 26*d* each extending in opposite directions substantially parallel to the longitudinal axis 11.

A first set of gas flow nozzles 27*a*, 27*d* can be formed by the branch-off flows 26*a* and 26*d* that are allowed to escape through substantially annular gaps 28*a*, 28*b* between the structure of the interruption chamber 2 that limits the arcing zone 10 in the radial direction and the two arcing contact pieces 12, 13 such that the electric arc 14 is broken at two interruption zones 29*a*, 29*d* at about sonic flow conditions.

As the branch-off gas flows 26*b*, 26*c* are allowed to escape through the outlets 20 by flow 35*a*, a second set of gas flow nozzles 27*b*, 27*c* can be formed by the branch-off flows 26*b* and 26*c* that break the electric arc 14 in a further two interruption zones 29*b*, 29*c* at about sonic flow conditions. This is particularly advantageous since the branch-off gas outflows 26*b*, 26*c* from the interruption zones form a stagnation zone 23*f* with poorly cooled gas. Hence, providing an outlet also contributes to the improvement of the dielectric withstand of the GCB in this area since the hot gas is lead off the interruption zone 10.

The number of interruption zones in the first exemplary embodiment 1 of the present disclosure is four whereas the number of interruption zones is four and the number of stagnation zones is three, wherein the interruption zones at the first inlet 15*a* belong to a first group of interruption zones and wherein the interruption zones at the second inlet 15*b* belong to a second group of interruption zones in the context of the present disclosure. The interruption zones are indicated by cross-marks on the line symbolizing the electric arc 14, whereas the stagnation zones are indicated with bullets at the branching portion of the flows and along the longitudinal axis 11, respectively. However, for an exemplary axial blown arc, the interruption zones can be expected proximate to the longitudinal axis but are indicated in this and the subsequent figures on the line symbolizing the electric arc 14 for the sake of easy understanding.

A hollow first arcing contact piece can allow a portion of the branch-off flow 26*a* to escape through the cavity proximal to the longitudinal axis 11 within the first arcing contact piece 12 to the exhaust. The same applies accordingly in case of a sleeve-like embodiment of the second arcing contact piece 13 in case that it is hollow.

In an exemplary embodiment, at least one of the insulation nozzles of the insulating nozzle 22, e.g. those at the inlets 15*a*, 15*b* can be used both for ablation and electric arc interruption whereas the remaining flow nozzles at the arcing piece contacts can be used for arc interruption only.

Figure 2:
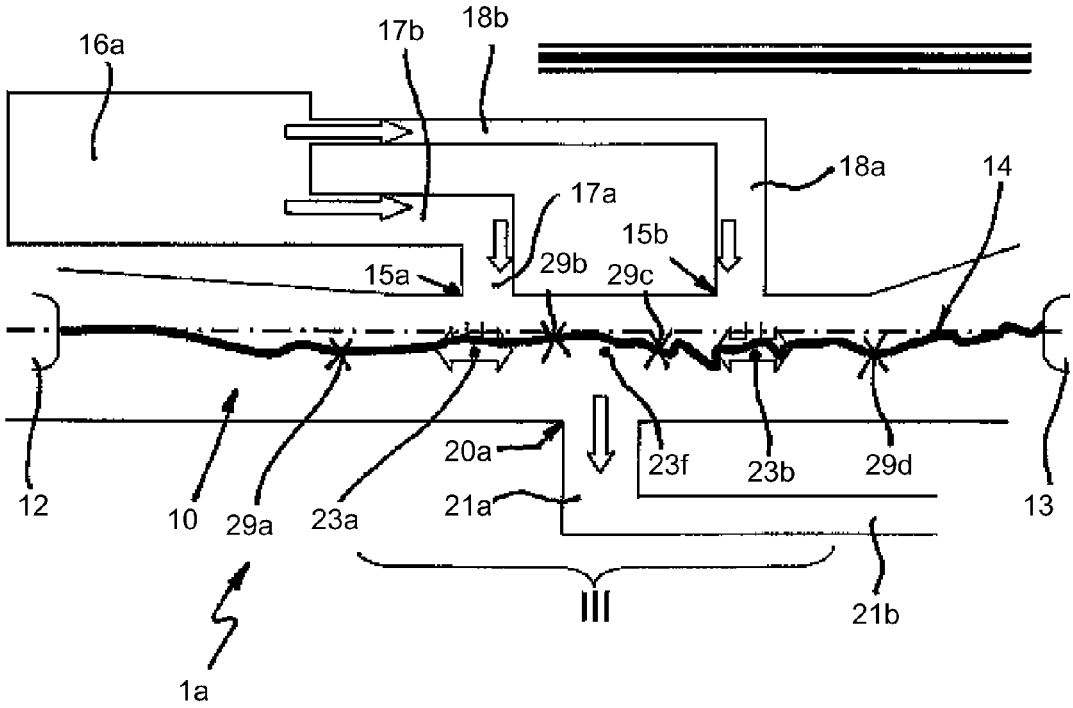
FIG. 2 illustrates a longitudinal view of a second circuit breaker in accordance with an exemplary embodiment.
Figure 3:
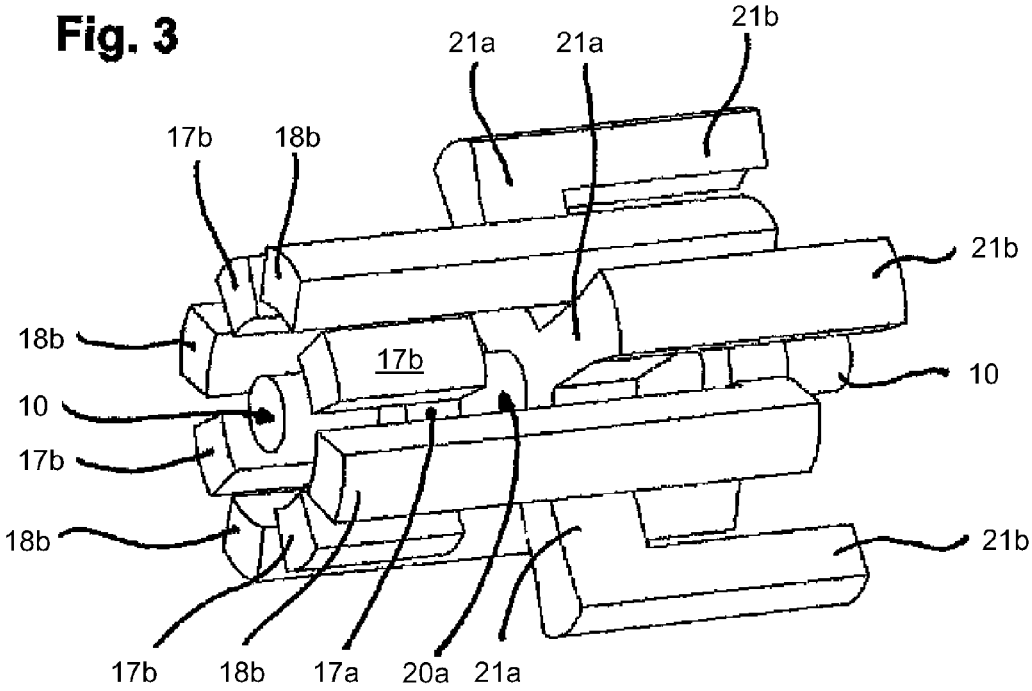
FIG. 3 illustrates a three-dimensional view of an arcing zone, a blowing channel system and an outlet channel system in a segment III of the second circuit breaker in accordance with an exemplary embodiment.

FIG. 2 illustrates a longitudinal view of a second a circuit breaker in accordance with an exemplary embodiment. FIG. 3 illustrates a three-dimensional view of an arcing zone, a blowing channel system and an outlet channel system in a segment III of the second circuit breaker in accordance with an exemplary embodiment. Identical or similar reference characters denote elements, flows or nozzles compared to the above embodiment 1 are identified as such so that a repetition thereof is redundant.

The second exemplary embodiment 1b differs from the first exemplary embodiment 1a in that its heating channels 17*a*, 18*a* and 17*b*, 18*b* are led separately into the pressure volume 16*a* via dedicated supply channel portions 17*b*, 18*b*. Such a set-up allows designing the shapes and/or sizes of all channel segments 17*a*, 18*a*, 17*b*, 18*b* independent of each other to a large extent, where necessary.

Each of the two inlets 15*a*, 15*b* can be designed for ablation or interruption. This, for example, can be specified if the diameters of the two inlets 15*a*, 15*b* are different and/or appropriate valves or other suitable restriction means controlling the flow through the heating channels 17*a*, 18*a* are to be designed.

FIG. 3 is a three-dimensional breakout view of the second embodiment 1a of the circuit breaker shown in FIG. 2 in a region III and shows four outlet channels 21*a*, 21*b* and thus four outlets 20*a* as well as four radial heating/blowing channels 17*a*, 18*a* and four corresponding horizontal heating/blowing supply channels 17*b*, 18*b* such that there are in fact eight inlets 15*a*, 15*b* present in this GCB which are all connected to the arcing zone 10. FIG. 3 further that the channels 17*a*, 17*b*, 18*a*, 18*b*, 21*a* and the continuation of the radial outlet channel portion 21*a* in corresponding horizontal outlet channel portions 21*b* are arranged axially symmetric.

In another exemplary embodiment, the radial outflow through the outlet can be improved by adding diffusers at the openings of the insulation nozzle or nozzles, respectively. Due to the increase of the flow cross section, sonic condition can be reached at the transition between insulation nozzle and diffuser.

Figure 4:
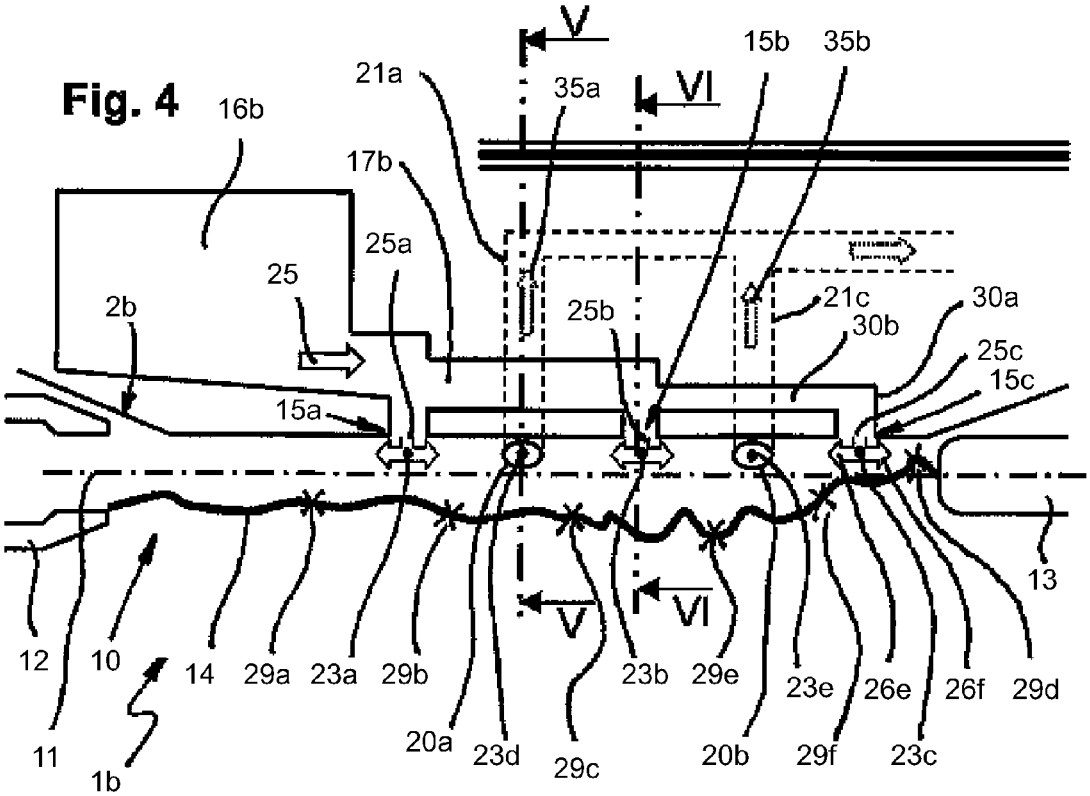
FIG. 4 illustrates a longitudinal view of a third embodiment of a circuit breaker in accordance with an exemplary embodiment.
Figure 5:
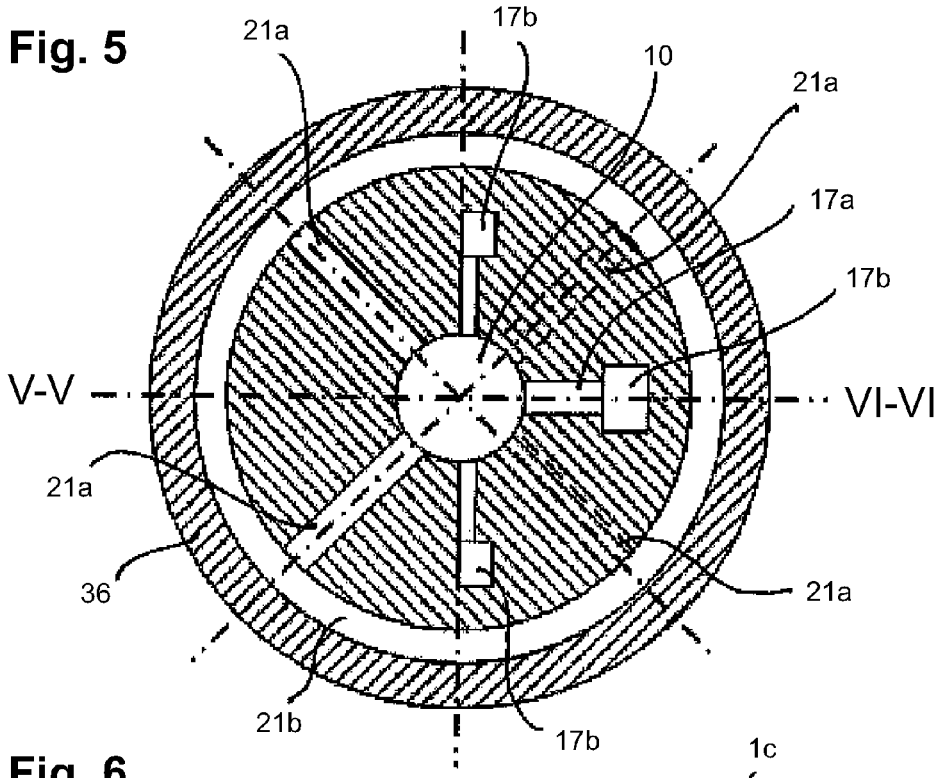
FIG. 5 illustrates a sectional view of the third circuit breaker along the cutting planes V-V and VI-VI in accordance with an exemplary embodiment.

FIG. 4 illustrates a longitudinal view of a third embodiment of a circuit breaker in accordance with an exemplary embodiment. FIG. 5 illustrates a sectional view of the third circuit breaker along the cutting planes V-V and VI-VI in accordance with an exemplary embodiment. Identical or similar reference characters denote elements, flows or nozzles compared to the above exemplary embodiment 1 are identified as such so that a repetition thereof is redundant.

The pressure volume 16*b* is larger than the pressure volume 16 of the first exemplary embodiment 1 because it provides an additional gas flow 25*c* via a horizontal blowing channel 30*b* and a radial blowing channel 30*a* to the arcing zone 10 via an additional inlet 15*c*. The third exemplary embodiment 1a differs from the first exemplary embodiment 1 in that the interruption chamber 2*b* features a second outlet 20*b* through which another portion of pressurized gas in form of a gas flow 35*b* from the pressure volume 16*b* is led out to the exhaust via a radial outlet channel portion 21*c*.

The gas flow 25*c* diverges at an additional stagnation zone 23*c* such that two branch-off flows 26*e*, 26*f* are formed which run in opposite directions off the stagnation zone 23*c* substantially parallel to the longitudinal axis 11.

In comparison with the exemplary embodiment of FIG. 1, it is the branch-off flow 26*f* and not the branch-off flow 26*d* that forms the gas nozzle proximate to the second arcing contact piece 13 whereas the branch-off flow 26*d* and the branch-off flow 26*e* are escaping through the additional outlet 20*b* at about sonic flow conditions such that the electric arc 14 is broken in two additional interruption zones 29*e*, 29*f* if one is to maintain the interruption zone 29*d* to the gas nozzle at the second arcing contact piece 13. Hence these are the interruption zones 29*a*, 29*b*, 29*c*, 29*d*, 29*d*, 29*e*, 29*f*, wherein in each case two neighboring interruption zones that are fed by the same assigned extinguishing flow 25, 25*a*, 25*b* belong to a group such that three groups of interruption zones are present, while the number of stagnation zones is increased by the additional stagnation zones 23*c*, 23*e* to five.

Another difference resides in that the third exemplary embodiment 1b features a sleeve-like shield 36 that is electrically connected with the second arcing contact piece 13. This shield 36 assigns the second interruption zone at the second arcing contact piece 13 to the thermal interruption whereas the unshielded portion with the first interruption zone at the first arcing contact piece 12 is assigned to the dielectric interruption.

As shown in FIG. 5, two sectional views of the nozzle system shown in FIG. 4 along the cutting planes V-V in the left halve of FIG. 5 and VI-VI in the right halve of FIG. 5 at the same time. Together with the sections indicated in FIG. 4 it becomes clear that the partial view VI-VI represented by the right halve of FIG. 5 is displaced to the partial view V-V in the direction of the longitudinal axis 11 such that most cavities such as the arcing zone 10, the blowing channel 17 as well as the outlet channel 21 are visible. The radial outlet channels 21*a* are indicated by dashed lines in the partial view VI-VI. The cross-sections of the arcing zone 10 and the heating/blowing channels 17*a*, 18*a*, 30*a* as well of the annular gaps between the interruption chamber wall delimiting the arcing zone 10 in a radial direction and the arcing contact pieces 12, 13 are set such that the desired gas flows are producible. FIG. 5 further reveals the three-dimensional arrangement and relationship of the heating/blowing channel system and the outlet channel system that are displaced to one another about 45 degrees in a circumferential direction to the longitudinal axis 11. Where specified another even or odd number of blowing and outlet channels can be selected whereas a reasonable balance between the complexity of the fluid system and the producibility of the device can be considered.

Figure 6:
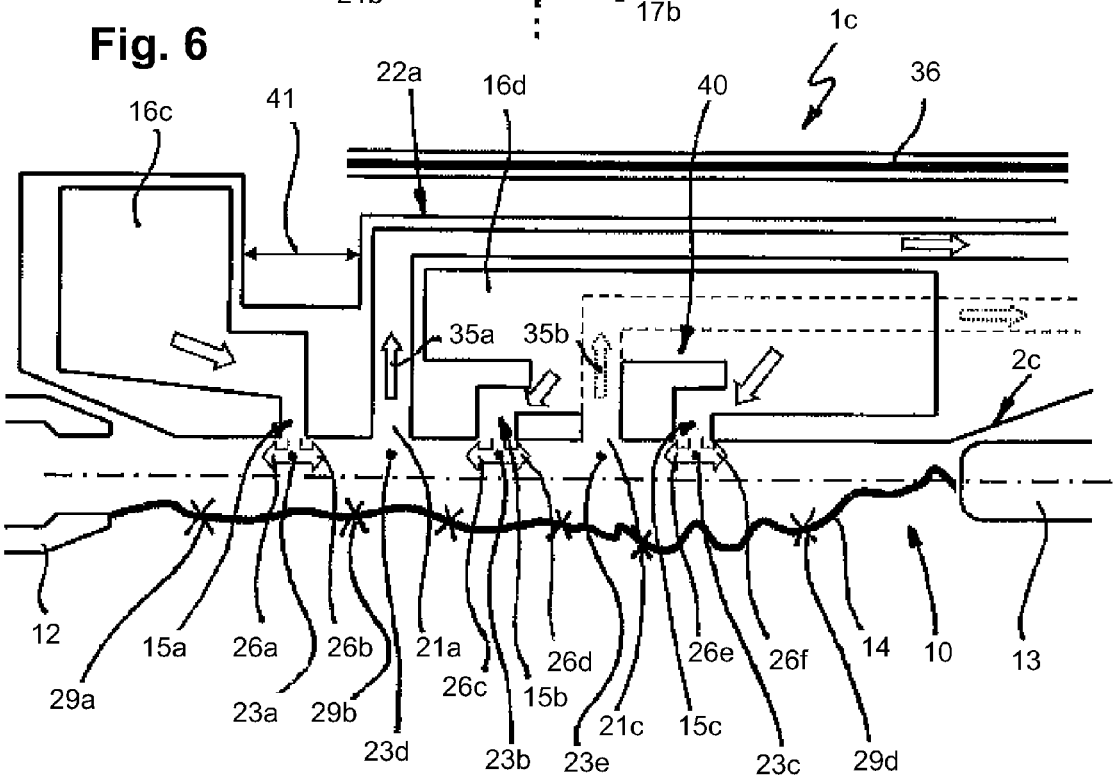
FIG. 6 illustrates a longitudinal view of a fourth circuit breaker in accordance with an exemplary embodiment.
Figure 7:
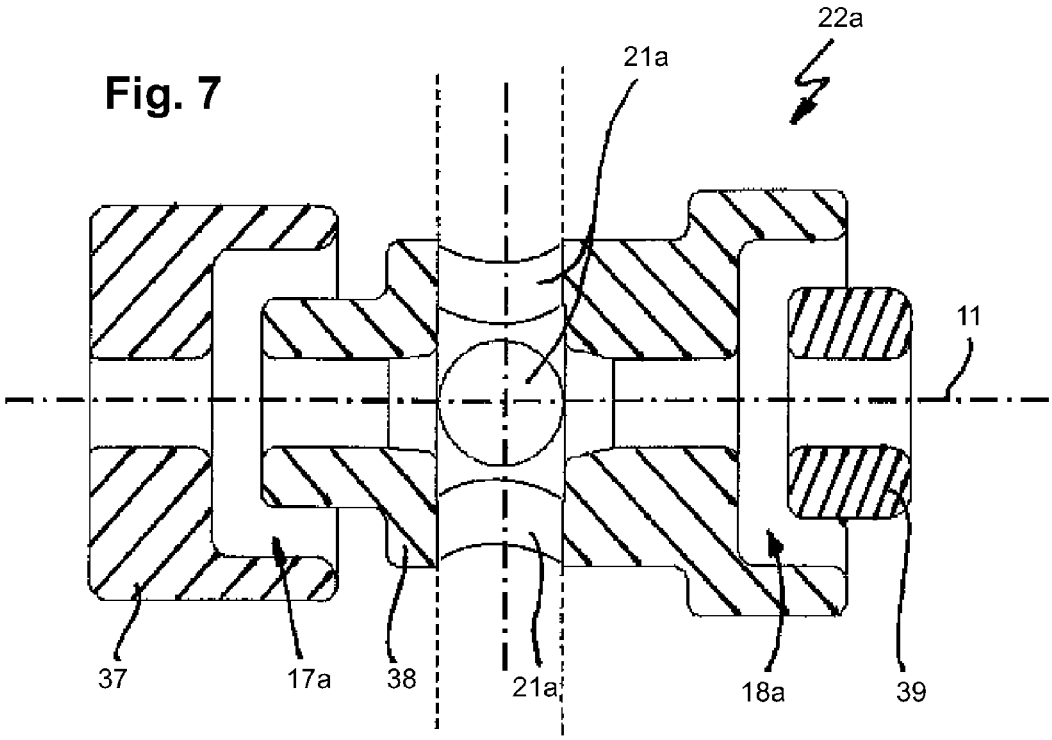
FIG. 7 illustrates insulating nozzle system of a fourth circuit breaker in accordance with an exemplary embodiment.

FIG. 6 illustrates a longitudinal view of a fourth circuit breaker in accordance with an exemplary embodiment. FIG. 7 illustrates insulating nozzle system of a fourth circuit breaker in accordance with an exemplary embodiment. Identical or similar reference characters denote elements, flows or nozzles compared to the above exemplary embodiment 1 are identified as such so that a repetition thereof is redundant. In contrast to the exemplary HV GCB's shown in FIGS. 1, 2 and 4 the lower portion interruption chamber is omitted since FIG. 6 focuses mainly on the means for leading the pressurized gas through three inlets 15*a*, 15*b*, 15*c* into the arcing zone 10. The formation and function of the nozzles of this exemplary embodiment is comparable to the third embodiment explained with reference to FIG. 4. For purposes of description herein, the terms "upper", "lower", "left", "right", "front", "vertical", "horizontal", and derivatives thereof shall relate to the disclosure as oriented in the enclosed figures. However, it is to be understood that the disclosure can assume various alternative orientations and step sequences, except where expressly specified to the contrary.

The fourth exemplary embodiment 1c differs to the third exemplary embodiment mainly in that there are two pressure volumes 16*c* and 16*d* instead of just one pressure volume and another outlet channel layout.

As shown in FIGS. 6 and 7, the left part of the breaker is designed to interrupt all currents that can be interrupted by known self-blast breakers, i.e. everything except the highest SLF currents for 60 Hz networks. The right part is a "booster" for thermal interruption which adds two groups with a total of four additional interruption zones for breaking the electric arc 14 and enables building up a dielectric gap 41 parallel to the thermal interruption. This gap 41 shall be dimensioned such that an electric fault between the shield 36 and the first arcing contact piece 12 is excluded.

With such an GCB having six interruption zones in total (see crosses along the electric arc 14 in FIG. 6) the specified clearing pressure at current zero can be maintained at a level comparative to those of known GCB's. This multiple interruption zone concept can be based on the double axial blown arc method having a radial outflow of gas through the outlet in order to decouple the gas flow from the different nozzle systems. The axial flows 26*a*-26*f* inside the gas nozzles are converted to radial gas flows at the radial outflow/outflows 35*a*, 35*b*.

FIG. 7 illustrates along together with FIG. 6 a possible insulation nozzle system 22*a* for the HV GCB according to the fourth exemplary embodiment 1c. The nozzle system 22*a* includes (e.g., consists of) three parts. A first part 37 (left) is fixed at a neighboring wall of its dedicated heating/pressure volume 16*c* and it is shaping the first heating channel 17*a*. A second part 38, shown as intermediate part in FIG. 7, includes four lateral openings 21*a* which serve as radial outlets for the outflows to an exhaust. This second part 38 is structurally positioned by four tubular channels (indicated by dashed lines) that are connected to the openings 21*a* and keep the second part 38 in place. The tubes serve also as exhaust tubes for the hot gas to the exhaust. A third piece 39 is again fixed at a neighboring wall of its dedicated other pressure/heating volume 16*d* and delimits the second blowing channel 18*a*.

Since the multi-part construction of the nozzle system 22*a* the first heating channel 17*a* and the second heating channels 18*a* are realized optimally as annular inlets 15*a*, 15*b*.

Figure 10:
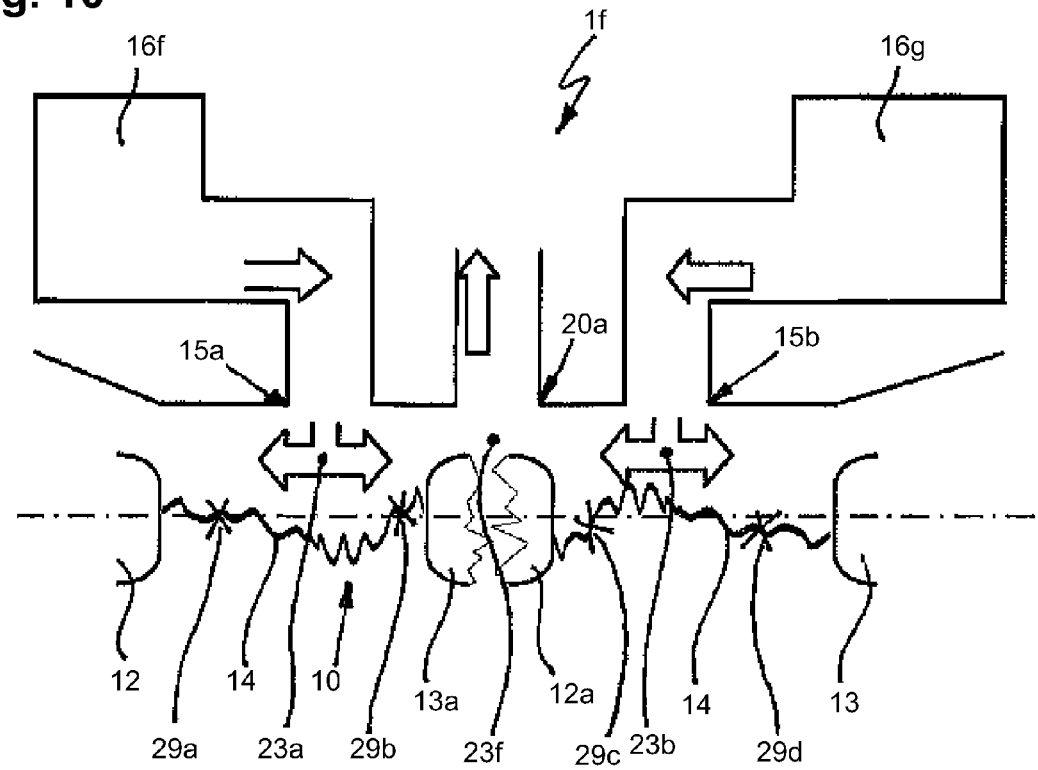
FIG. 10 illustrates a longitudinal view of a seventh circuit breaker in accordance with an exemplary embodiment.

Alternative solutions for the concept disclosed in embodiment 1c can be realized e.g. in that the heating volumes and the nozzles are fixed and a piston, the arcing and arcing contact pieces are moving. In exemplary embodiments this design can be advantageous for systems operating at different gas pressure in each of the two pressure volumes, since in such a case the plug 13 should not travel a long distance to reach the fully open position. The arcing contact pieces are separable with similar speeds, thus shortening the overall travel time. An alternative, but also efficient way of shortening the arcing time is to use two pairs of arcing contacts in the arcing contact piece arrangement such as shown in FIG. 10. In this case the displacements will be twice as short and use less drive energy.

In another exemplary embodiment, the outflow channels 21*a*, 21*c* can be blocked until the second arcing contact piece 13 is in its open end position as long as the specified minimum and maximum arcing time is provided.

Optionally, the outflow pipes/cylinders can be fixed to the nozzle such that they can slide through the heating volume and the other way around.

Figure 8:
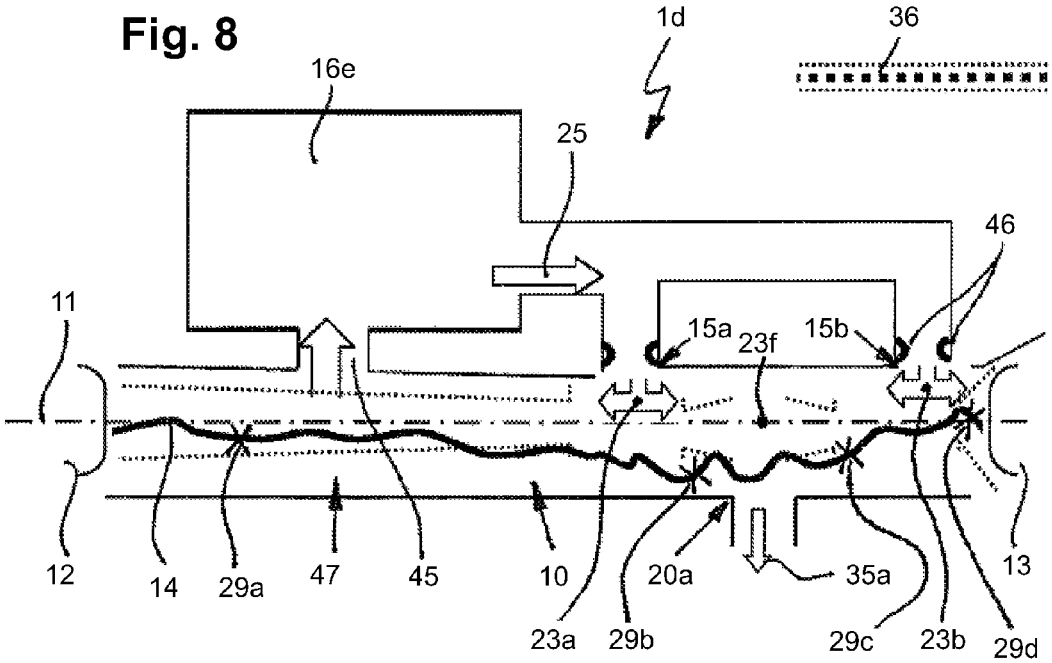
FIG. 8 illustrates a longitudinal view of a fifth circuit breaker in accordance with an exemplary embodiment.

FIG. 8 illustrates a longitudinal view of a fifth circuit breaker in accordance with an exemplary embodiment. Identical or similar reference characters denote elements, flows or nozzles compared to the above embodiments are identified as such so that a repetition thereof is redundant.

In comparison with the first exemplary embodiment 1 whose heating channels also serve as blowing channels, the pressure volume 16*e* of the GCB to the fifth exemplary embodiment 1d is fed by a separate heating channel 45 that connects the pressure volume 16*e* with the arcing zone 10 such that the remaining channel system including the inlet channel portions 17*a*, 17*b*, 18*a* and 18*b* serves mainly as blowing channels.

Hence an annular ablation zone 47 is located as close as possible to the heating channel 45.

Where necessary, the hot gases can be hindered on entering the pressure volume 16*e* excessively. This result can be advantageous to arrange valve-like restriction means 46 or other suitable channel design restricting or limiting undesired gas flows in one direction to the inlets 15*a*, 15*b* and/or in the direction of the longitudinal axis 11.

However, the interruption nozzles 27*a* and 27*b* need not necessarily coincide with the dielectric gap. It is possible that a part of the nozzle system where the interruption takes place is shielded and does not influence the dielectric performance of the breaker (see dotted shield 36). The parts of the nozzle should not be shielded completely, however partial shielding is probably possible.

Figure 9:
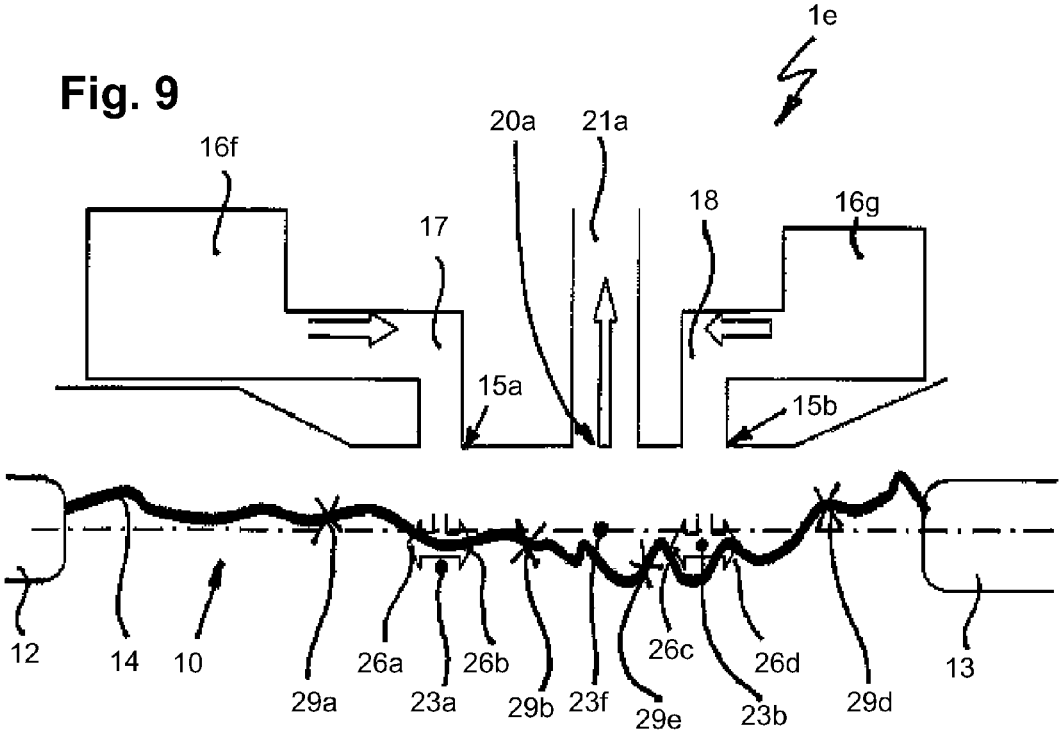
FIG. 9 illustrates a longitudinal view of a sixth circuit breaker in accordance with an exemplary embodiment.

FIG. 9 illustrates a longitudinal view of a sixth circuit breaker in accordance with an exemplary embodiment. The sixth exemplary embodiment 1e is analogous to the first embodiment 1 in FIG. 1 and relates due to the plural pressure chamber system somewhat also to the fourth exemplary embodiment. Identical or similar reference characters denote elements, flows or nozzles compared to the above embodiments are identified as such so that a repetition thereof is redundant.

In contrast to the first exemplary embodiment 1 does the sixth exemplary embodiment 1e include two pressure volumes 16*f* and 16*g* which are connected to the inlets 15*a*, 15*b* by channels 17, 18 serving both as heating and blowing channels. The branch-off flows 26*b*, 27*c* are led out of the arcing zone 10 by the outlet 20*a* to an exhaust such that each inlet 15*a*, 15*b* is assigned in each case one group of interruption zones having two interruption zones 26*a*, 26*b* and 26*c*, 26*d* each.

Such a set-up leads to a quite simple geometric solution of the exemplary GCB compared to the one according to previous embodiments.

FIG. 10 illustrates a longitudinal view of a seventh circuit breaker in accordance with an exemplary embodiment. The seventh exemplary embodiment 1e is in principle and function the same as that of the GCB according to the sixth exemplary embodiment. Hence, identical elements bear identical or similar reference numerals.

A difference of the seventh exemplary embodiment 1e compared to sixth exemplary embodiment resides in that it features two pairs of arcing contacts that include the first arcing contact piece 12, the second arcing contact piece 13 and two intermediate arcing contact pieces 12*a*, 13*a* in the arcing contact piece arrangement located within one arcing chamber 10 as shown in FIG. 10. Here, the displacements of the arcing contact pieces can be twice as short as those from the first embodiment and thus specify less drive energy. In other words, the two groups of interruption zones that are fed by their dedicated inlets 15*a*, 15*b* are also separated from one another by the intermediate arcing contact pieces 12*a*, 13*a*.

Figure 11:
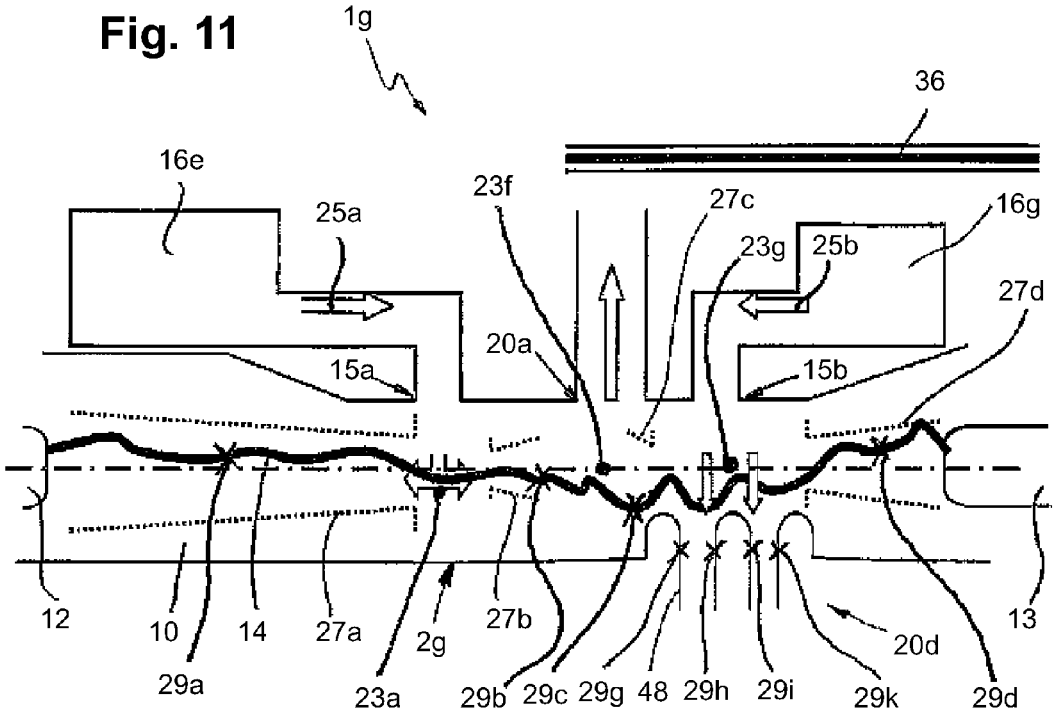
FIG. 11 illustrates a longitudinal view of an eighth circuit breaker in accordance with an exemplary embodiment.

FIG. 11 illustrates a longitudinal view of an eighth circuit breaker in accordance with an exemplary embodiment. As shown in FIG. 1 an additional outlet 20*c* is arranged about opposite of the second inlet 15*b* at the interruption zone 10, wherein one group of axial interruption zones 29*a*, 29*b* is separated by the outlet 20*a* from another group of cross blown interruption zones 29*g*, 29*h*, 29*i*, 29*k*.

The left hand sided flow nozzles 27*a*, 27*b* in the unshielded area with the axial interruption zones 29*a*, 29*b* are intended for dielectric interruption whereas the additional outlet 20*c* and the right hand side flow nozzle 27*d* are provided to cope with the thermal interruption.

The additional outlet 20*c* interrupts the electric arc 14 by cross-blowing such that the corresponding second interruption zone is referred to as cross-blow interruption zones in that it is broken at a plurality of interruption zones 29*g*, 29*h*, 29*i*, 29*k* located on inner sides of splitter plates 48 that are partitioning the outlet 20*c* as the gas flow streaming out of the second pressure volume 16*g* pushed it towards an exhaust.

The second branch-off 27*b* of the gas portion of the first group is allowed to escape through the first outlet 20*a* to the exhaust.

Advantageously the first outlet 20*a* is also fed by a third branch-off portion 27*c* of the gas from the second inlet 15*b* of the second group of interruption zones.

The cross-blow interruption zone is located in an add-on unit to the first interruption zone on the left hand side thereof which is housed in a common GCB housing that is part of a somewhat two-part interruption chamber 2*g*. However, both the axial interruption zones and the cross-blow interruption zones can be arranged within the common arcing zone 10.

Figure 12:
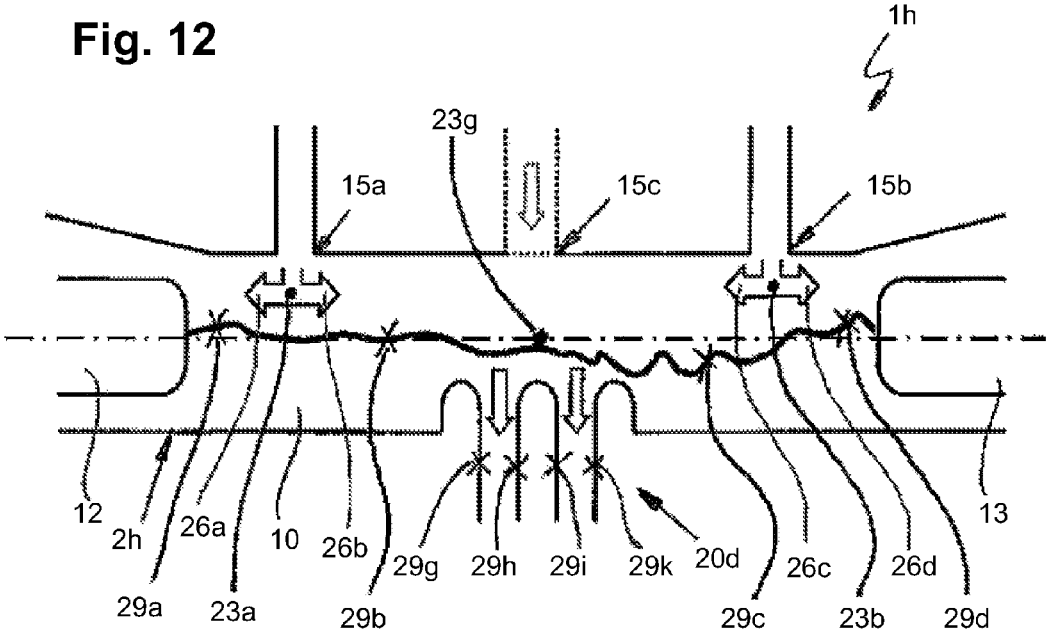
FIG. 12 illustrates a longitudinal view of a ninth circuit breaker in accordance with an exemplary embodiment.

FIG. 12 illustrates a longitudinal view of a ninth circuit breaker in accordance with an exemplary embodiment. As shown in FIG. 12*whether* the pressurized gas that is led through the inlets 15*a*, 15*b* origins of one or two pressure volumes shall not be relevant for this embodiment 1 h. Compared to the eight exemplary embodiment of FIG. 11, the additional outlet 20*d* replaces the outlet 20*a* as shown in FIG. 1 for example although it has substantially the same function, providing an escapement path for the branch-off gas flows 26*b*, 26*c* of the two axial interruption zones from the two groups of axial interruption zones. This embodiment forms sort of a hybrid-type GCB employing both axial and cross-blow interruption concepts wherein the ablation of insulation material takes place at the inlets 15*a*, 15*b* located away from the additional outlet 20*c* located about midways between the inlets 15*a*, 15*b*.

If the energy of the gas flowing out at the additional outlet 20*c* is too small to cause the desired additional interruption zones 29*g*, 29*h*, 29*i*, 29*k* an additional inlet 15*c* can be provided opposite of the additional outlet 20*c* at the interruption zone in the interruption chamber 2*h*. The additional outlet 20*c* can be served by any of the pressure volumes serving the inlets 15*a*, 15*b* or by a puffer system, for example.

Although the three-dimensionality of the channel and insulation nozzle system has been explained mainly in view of the third and fourth exemplary embodiments the remaining embodiments shall not understood to be limited to include only the displayed channel system as they well include corresponding arrangements that are displaced about an angle about the longitudinal axis in any suitable number.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE CHARACTERS

1,1*a*,1*b*,1*c*,1*d*,1*e*,1*f* high voltage circuit breaker
1*g*,1*h*
2,2*a*,2*b*,2*c*,2*d*,2*e*,2*f* interruption chamber
2*g*,2*h*
10 arcing zone
11 longitudinal axis
12,12*a* first arcing contact piece
13,13*a* second arcing contact piece
14 electric arc
15*a*,15*b*,15*c* inlet
16,16*a*,16*b*,16*c*,16*d*, pressure volume
16*e*,16*f*,16*g*
17*a*, 18*a*, 25*a* radial blowing channel portion
17*b*, 18*b*, 30*b* horizontal supply channel portion
19 channel intersection
20*a*,20*b*,20*c*,20*d* outlet; additional outlet
21*a*,21*c* radial outlet channel portion
21*b*,21*d* horizontal outlet channel portion
22,22*a* insulation nozzle
23*a*,23*b*,23*c*,23*d*,23*e* stagnation zone
23*f*,23*g*
25,25*a*,25*b* gas flow
26*a*,26*b*,26*c*,26*d*,26*e* branch-off (gas) flow
26*f*
27*a*,27*b*,27*c*,27*d* gas nozzle/flow nozzle
28*a*,28*b* annular gap
29*a*,29*b*,29*c*,29*d*,29*e* arc interruption zone
29*f*,29*g*,29*h*,29*i*,29*k*
35*a*,35*b* outlet gas flow
36 shield
37 first part (of 22*a*)
38 second part (of 22*a*)
39 third part (of 22*a*)
40 certain area of the interruption chamber
41 dielectric gap
45 separate heating channel
46 restriction means
47 ablation zone
48 splitter plates

What is claimed is:

1. A high-voltage circuit breaking method, comprising:

providing an interruption chamber filled with an extinguishing agent, said interruption chamber having one arcing zone and at least two separable arcing contact pieces that move relative to one another;

separating the at least two arcing contact pieces from one another such that an electric arc is generated between said arcing contact pieces in the arcing zone; and interrupting said electric arc in at least three interruption zones, wherein two groups of interruption zones are formed, wherein one group has at least one interruption zone, and wherein both groups are separated by an outlet through which a portion of said extinguishing agent is led out of said arcing zone.

2. The high-voltage circuit breaking method according to claim 1, comprising:

generating the electric arc through an alternating current.

3. The high-voltage circuit breaking method according to claim 1, wherein the electric arc extends continuously between exactly two arcing contact pieces.

4. The high-voltage circuit breaking method according to claim 1, comprising:

extending the arcing zone along a longitudinal axis; and leading at least one extinguishing flow of extinguishing agent into the interruption zone transversely to said longitudinal axis such that at least one of a group of radial interruption zones is formed and at least one extinguishing flow of extinguishing agent is led into the interruption zone such that a group of axial interruption zones is formed.

5. The high-voltage circuit breaking method according to claim 4, wherein at least one group comprises two axial interruption zones and a stagnation zone located therebetween on said longitudinal axis.

6. The high-voltage circuit breaking method according to claim 1, comprising:

interrupting the electric arc in the interruption zones by leading extinguishing flows of the extinguishing agent into said arcing zone through at least two inlets and by leading a portion of said extinguishing agent out of said arcing zone through an outlet located between said two inlets.

7. The high-voltage circuit breaking method according to claim 1, wherein the extinguishing agent is a gas that is pressurized at the time of entering the arcing zone.

8. The high-voltage circuit breaking method according to claim 7, comprising:

pressurizing said extinguishing agent by an externally actuated system.

9. The high-voltage circuit breaking method according to claim 7, comprising:

pressurizing said extinguishing agent due to energy generated by the electric arc in at least one pressure volume is connected to the arcing zone by a heating channel each due to energy generated by the electric arc, and by interrupting said electric arc in each interruption zone arc by leading the pressurized gas via a blowing channel through the corresponding inlet into the arcing zone.

10. The high-voltage circuit breaking method according to claim 9, wherein the at least one heating channel is the at least one blowing channel.

11. The high-voltage circuit breaking method according to claim 6, comprising:

leading the gas through the inlets into the arcing zone such that at least one multi-directional gas flow is formed.

12. The high-voltage circuit breaking method according to claim 11, wherein the at least one multi-directional gas flow is configured such that the electric arc is interrupted in a substantially symmetric manner in relation to the longitudinal axis.

13. The high-voltage circuit breaking method according to claim 11, wherein the at least one multi-directional gas flow is a double axial gas flow, whose branch-offs extend along the longitudinal axis, such that at least two axial arc interruption zones are formed.

14. The high-voltage circuit breaking method according to claim 10, wherein the electric arc is interrupted in six axial interruption zones by three groups of interruption zones, wherein each group of interruption zones has two axial interruption zones.

15. The high-voltage circuit breaking method according to claim 14, wherein each of the three groups is assigned one extinguishing flow that is led into the arcing zone, wherein two neighboring groups are in each case separated by an outlet.

16. The high-voltage circuit breaking method according to claim 14, wherein at least two neighboring groups are in each case separated from one another by a stagnation zone located therebetween.

17. A high voltage circuit breaker comprising:

an interruption chamber filled with an extinguishing agent;

at least two separable arcing contact pieces that are movable relative to one another; and one arcing zone in which an electric arc is producible in between the at least two separable arcing contact pieces during an interruption process, wherein said interruption chamber includes at least two inlets and at least one outlet located in between the two inlets, and said inlets and the at least one outlet are connected with said arcing zone such that the electric arc is extinguishable in at least three interruption zones, which are formed by means of extinguishing flows of extinguishing agent streaming from the at least two inlets into the arcing zone upon pressurization, wherein a portion of the extinguishing agent is inserted in said arcing zone, and wherein a portion of said extinguishing flows is led through said outlet out of the arcing zone.

18. The high voltage circuit breaker according to claim 17, wherein the extinguishing agent is a gas.

19. The high voltage circuit breaker according to claim 18, wherein the gas is produced by a self-blast type circuit breaker.

20. The high voltage circuit breaker according to claim 18, wherein at least one pressure volume is connected to at least one of the inlets via at least one blowing channel.

21. The high voltage circuit breaker according to claim 20, wherein exactly one pressure volume is connected to the blowing channel via at least one of a common supply channel portion for connecting several blowing channels and a separate supply channel portion for connecting exactly one blowing channel.

22. The high voltage circuit breaker according to claim 21, wherein at least two of said inlets forming mouths of dedicated blowing channels, are connected to separate pressure volumes each via at least one of a common supply channel portion and a separate supply channel portion.

23. The high voltage circuit breaker according to claim 21, wherein the pressure volume is connected to the arcing zone by at least one heating channel.

24. The high voltage circuit breaker according to claim 21, wherein at least one of a blowing channel, a heating channel and a pressure volume is arranged symmetrically to a longitudinal axis is defined by the substantially rotational symmetric arcing zone.

25. The high voltage circuit breaker according to claim 17, wherein at least one of the inlets, the blowing channel and the at least one outlet includes a acting resistance means.

26. The high voltage circuit breaker according to claim 17, wherein at least one outlet is designed as a cross-blowing outlet.

27. The high voltage circuit breaker according to claim 17, wherein a shield is electrically connected to one of the separable arcing contact pieces for shifting field lines of an electric field towards another one of the separable contact pieces.

* * * * *